US012038007B2

(12) United States Patent
De Bock et al.

(10) Patent No.: US 12,038,007 B2
(45) Date of Patent: Jul. 16, 2024

(54) LIQUID RING PUMP CONTROL

(71) Applicant: Edwards Technologies Vacuum Engineering (Qingdao) Company Limited, Shandong (CN)

(72) Inventors: Andries Daniel Jozef De Bock, Cologne (DE); Xin Dai, Shandong (CN); Xibo Liu, Shandong (CN)

(73) Assignee: Edwards Technologies Vacuum Engineering (Qingdao) Company Limited, Shandong (CN)

( * ) Notice: Subject to any disclaimer, the term of this patent is extended or adjusted under 35 U.S.C. 154(b) by 63 days.

(21) Appl. No.: 18/001,803

(22) PCT Filed: Jun. 17, 2021

(86) PCT No.: PCT/IB2021/055357

§ 371 (c)(1),
(2) Date: Dec. 14, 2022

(87) PCT Pub. No.: WO2021/260504

PCT Pub. Date: Dec. 30, 2021

(65) Prior Publication Data

US 2023/0243353 A1 Aug. 3, 2023

(30) Foreign Application Priority Data

Jun. 26, 2020 (WO) ..... PCT/CN2020/098308

(51) Int. Cl.
*F04C 28/24* (2006.01)
*F04C 19/00* (2006.01)

(52) U.S. Cl.
CPC ..... *F04C 28/24* (2013.01); *F04C 19/00* (2013.01)

(58) Field of Classification Search
CPC ..... F04C 28/24; F04C 19/00; F04C 19/004; F04C 2240/081
See application file for complete search history.

(56) References Cited

U.S. PATENT DOCUMENTS 4,655,688 A * 4/1987 Bohn ..... F04C 19/001 417/18
2018/0245594 A1* 8/2018 Chabala ..... F04C 28/06

FOREIGN PATENT DOCUMENTS

DE 2503873 A1 8/1976
GB 2540582 A 1/2017
(Continued)

OTHER PUBLICATIONS

British Examination Report dated Feb. 10, 2021 and Search Report dated Feb. 9, 2021 for corresponding British application Serial No. GB2014870.6.

(Continued)

*Primary Examiner* — Kenneth J Hansen
(74) *Attorney, Agent, or Firm* — Theodore M. Magee; Westman, Champlin & Koehler, P.A.

(57) ABSTRACT

A system comprising: a liquid ring pump (10) comprising: a chamber (102); a suction inlet; an exhaust outlet; and an operating liquid inlet; a gas line (36) coupled to the liquid ring pump (10); a valve (8) disposed on the gas line (36); a first sensor (81) configured to measure a first parameter of the inlet fluid; a second sensor (82) configured to measure a second parameter of either the operating liquid, the exhaust fluid, or a fluid within the chamber; and a controller (20) configured to: determine a vapour pressure of the operating liquid using the second parameter; and control operation of the valve (8) based on the first parameter and the vapour pressure.

15 Claims, 3 Drawing Sheets

(56) References Cited

FOREIGN PATENT DOCUMENTS

| | | | | |
|---|---|---|---|---|
| GB | 2571968 | A | 9/2019 | |
| WO | 2007135504 | A1 | 11/2007 | |
| WO | 2019175822 | A1 | 9/2019 | |
| WO | 2019175823 | A1 | 9/2019 | |
| WO | WO-2019175822 | A1 * | 9/2019 | ..... F04C 19/00 |

OTHER PUBLICATIONS

PCT Notification of Transmittal of the International Search Report and the Written Opinion of the International Searching Authority of the Declaration and PCT International Search Report dated Aug. 26, 2021 for PCT application Serial No. PCT/IB2021/055357, 5 pages.
PCT International Written Opinion dated Aug. 26, 2021 for PCT application Serial No. PCT/IB2021/055357, 5 pages.

* cited by examiner

LIQUID RING PUMP CONTROL

CROSS-REFERENCE OF RELATED APPLICATION

This application is a Section 371 National Stage Application of International Application No. PCT/IB2021/055357, filed Jun. 17, 2021, and published as WO 2021/260504A1 on Dec. 30, 2021, the content of which is hereby incorporated by reference in its entirety and which claims priority of Chinese Application No. PCT/CN2020/098308, filed Jun. 26, 2020.

FIELD

The present invention relates to the control of liquid ring pumps.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

Examples of liquid ring pumps include single-stage liquid ring pumps and multi-stage liquid ring pumps. Single-stage liquid ring pumps involve the use of only a single chamber and impeller. Multi-stage liquid ring pumps (e.g. two-stage) involve the use of multiple chambers and impellers connected in series.

The discussion above is merely provided for general background information and is not intended to be used as an aid in determining the scope of the claimed subject matter. The claimed subject matter is not limited to implementations that solve any or all disadvantages noted in the background.

SUMMARY

Cavitation tends to be a significant cause of wear and failure in certain liquid ring pumps, especially those operating at a low-pressure/high-vacuum condition. Also, cavitation can lead to a disturbing noise. Thus, it tends to be desirable to prevents or oppose start-up cavitation in a liquid ring vacuum pump.

The present inventors have realised that cavitation can be reduced or eliminated by introducing a flow of air into the inlet manifold of the liquid ring pump.

In an aspect, there is provided a system comprising: a liquid ring pump comprising a chamber, a suction inlet, an exhaust outlet, and an operating liquid inlet, wherein the liquid ring pump is configured to pump an inlet fluid into the chamber via the suction inlet, pump an exhaust fluid out of the chamber via the exhaust outlet, and receive an operating liquid into the chamber via the operating liquid inlet; a gas line coupled to the liquid ring pump such that a gas may flow into the chamber of the liquid ring pump via the gas line; a valve disposed on the gas line; a first sensor configured to measure a first parameter of the inlet fluid; a second sensor configured to measure a second parameter of a fluid selected from the group of fluids consisting of the operating liquid, the exhaust fluid, and a fluid within the chamber; and a controller configured to determine a vapour pressure of the operating liquid using the measurement of the second parameter, and control operation of the valve based on the measurement of the first parameter and the determined vapour pressure.

The first parameter may be a pressure. The second parameter may be a temperature.

The controller may be configured to determine the vapour pressure of the operating liquid using the Antoine formula. The controller may be configured to compare the measurement of the first parameter and the determined vapour pressure, and to control the operation of the valve based on that comparison. The controller may be configured to determine a difference between the measurement of the first parameter and the determined vapour pressure, and to control the operation of the valve based on the determined difference. The controller may be configured to compare the determined difference to a threshold value, and to control the operation of the valve based on that comparison. The controller may be configured to: if the determined difference is greater than the threshold value, control the valve to close or remain closed; and, if the determined difference is less than or equal to the threshold value, control the valve to open or remain open. The controller may be configured to control operation of the valve such that the degree to which the valve is opened depends on the determined difference between the measurement of the first parameter and the determined vapour pressure.

The system may further comprise a suction line coupled to the suction inlet and a non-return valve disposed on the suction line. The non-return valve may be arranged to permit fluid to flow into the chamber via the suction line and to prevent or oppose fluid flow out of the chamber to the suction line. The gas line may be coupled to the suction line between the non-return valve and the suction inlet of the liquid ring pump. The first sensor may be coupled to the suction line between the non-return valve and the suction inlet of the liquid ring pump.

The liquid ring pump may comprise an inlet manifold. The valve may be integrated in the inlet manifold.

The gas may be air or an inert gas.

The system may further comprise: an exhaust line coupled to the exhaust outlet; and/or an operating liquid line coupled to the exhaust operating liquid inlet. The second sensor may be coupled to either the exhaust line or the operating liquid line.

In a further aspect, there is provided a control method for controlling a system, the system comprising a liquid ring pump, a gas line, and a valve disposed on the gas line, wherein the liquid ring pump comprises a chamber, a suction inlet, an exhaust outlet, and an operating liquid inlet, the liquid ring pump is configured to pump an inlet fluid into the chamber via the suction inlet, pump an exhaust fluid out of the chamber via the exhaust outlet, and receive an operating liquid into the chamber via the operating liquid inlet, and the gas line is coupled to the liquid ring pump such that a gas may flow into the chamber of the liquid ring pump via the gas line, the method comprising: measuring a first parameter of the inlet fluid; measuring a second parameter of a fluid selected from the group of fluids consisting of the operating liquid, the exhaust fluid, and a fluid within the chamber; determining a vapour pressure of the operating liquid using the measurement of the second parameter; and controlling operation of the valve based on the measurement of the first parameter and the determined vapour pressure.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
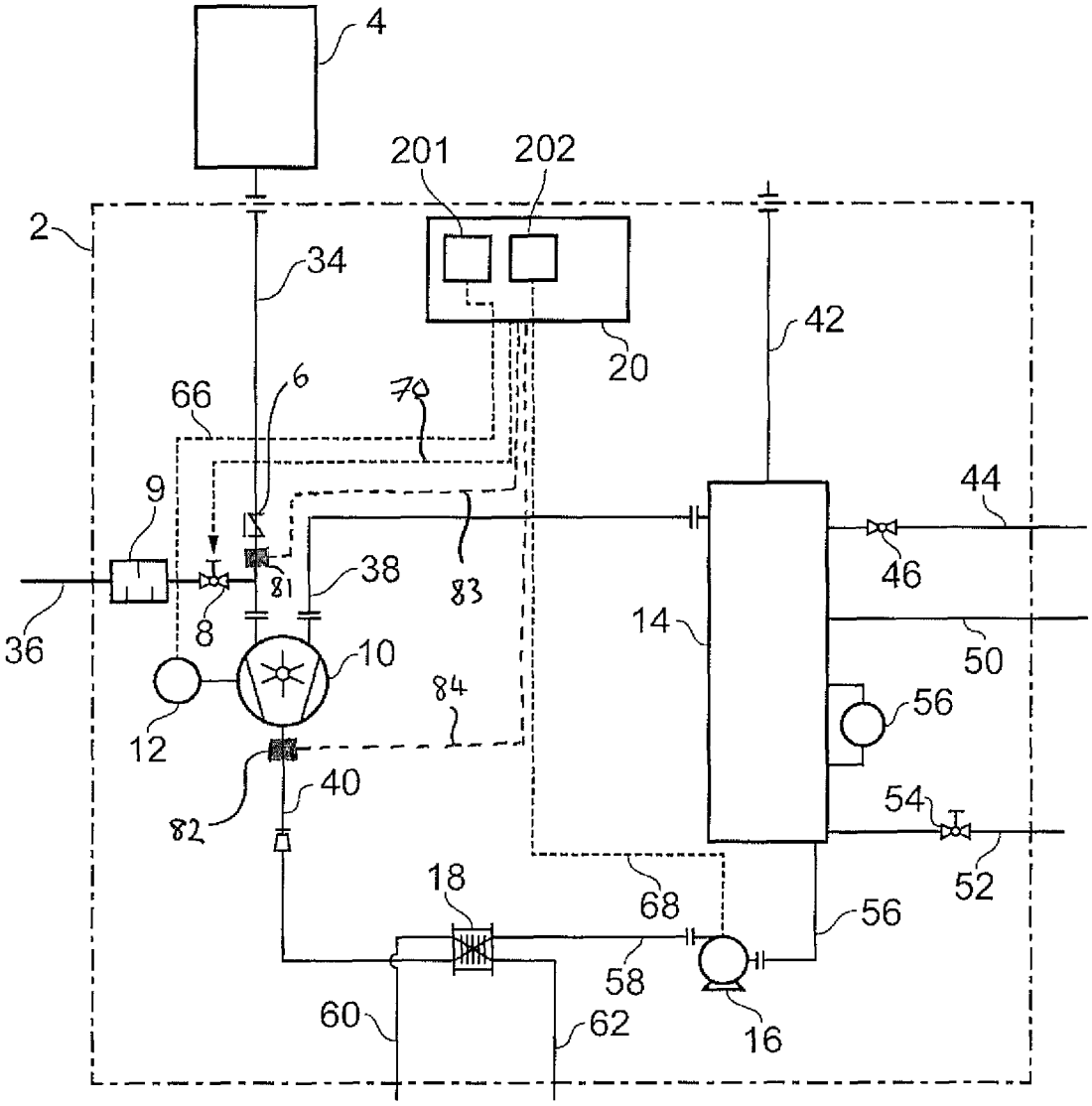
FIG. 1 is a schematic illustration (not to scale) showing a vacuum system.

FIG. 1 is a schematic illustration (not to scale) showing a vacuum system 2. The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, a first valve 8, a silencer 9, a liquid ring pump 10, a motor 12, a separator 14, a pump system 16, a heat exchanger 18, a controller 20, a first sensor 81, and a second sensor 82.

The facility 4 is connected to a gas inlet of the liquid ring pump 10 via a suction or vacuum line or pipe 34.

In this embodiment, the non-return valve 6 is disposed on the suction line 34. Also, the first sensor 81 is disposed on the suction line 34. The non-return valve 6 is disposed between the facility 4 and the first sensor 81. The first sensor 81 is disposed between the non-return valve 6 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

In this embodiment, the first sensor 81 is a pressure sensor. The first sensor 81 is configured to measure a pressure of the gas flowing in the suction line 34, i.e. the pressure of the gas being pumped from the facility 4 by the action of the liquid ring pump 10. The first sensor 81 may be any appropriate type of pressure sensor. The first sensor 81 is connected to the controller 20 via a first sensor connection 83 such that the measurements taken by the first sensor 81 are sent from the first sensor 81 to the controller 20. The first sensor connection 83 may be any appropriate type of connection including, but not limited to, an electrical wire or an optical fibre, or a wireless connection.

The gas inlet of the liquid ring pump 10 is further connected to an air (or gas) pipe 36 (which may also be referred to as an air (or gas) line) via which air can be fed into the gas inlet of the liquid ring pump 10. In this embodiment, the air pipe 36 is coupled to the suction line 34 between the first sensor 81 and the gas inlet of the liquid ring pump 10

The first valve 8 is disposed on the air pipe 36. The silencer 9 is disposed on the air pipe 36. The first valve 8 is disposed between the suction line 34 and the silencer 9. The silencer 9 is disposed between the first valve 8 and an inlet of the suction line 34.

The first valve 8 may be a solenoid valve.

The silencer 9 may also be referred to as a muffler. The silencer 9 is an acoustic device configured to reduce the loudness of the sound pressure within the air pipe 36 created by the liquid ring pump 10 drawing in air through the air pipe 36.

In this embodiment, the liquid ring pump 10 is a single-stage liquid ring pump.

The gas inlet of the liquid ring pump 10 is connected to the suction line 34. A gas outlet of the liquid ring pump 10 is connected to an exhaust line or pipe 38. The liquid ring pump 10 is coupled to the heat exchanger 18 via a first operating liquid pipe 40. The liquid ring pump 10 is configured to receive the operating liquid from the heat exchanger 18 via the first operating liquid pipe 40. The liquid ring pump 10 is driven by the motor 12. Thus, the motor 12 is a driver of the liquid ring pump 10.

Figure 2:
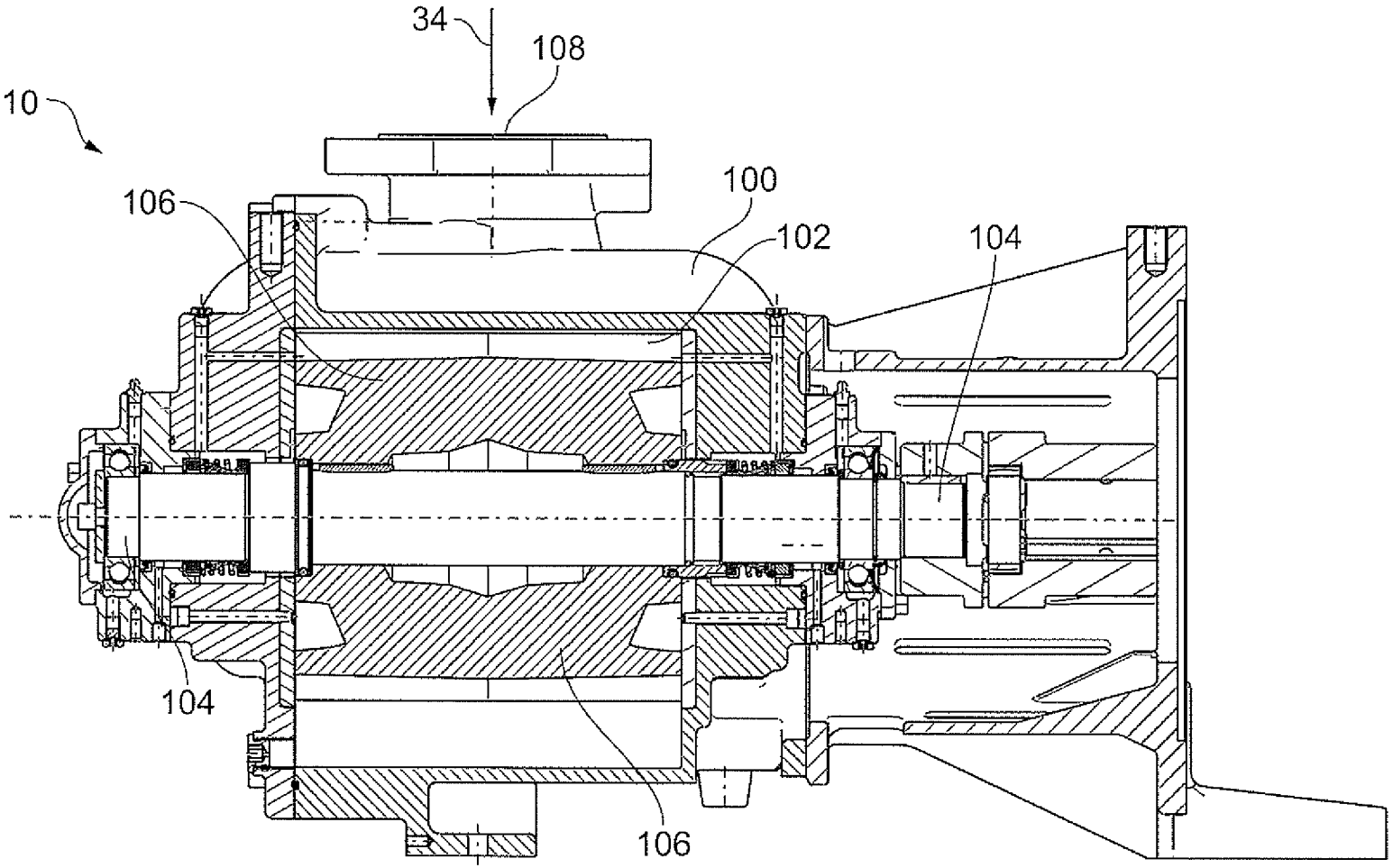
FIG. 2 is a schematic illustration (not to scale) of a liquid ring pump.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

In this embodiment, the liquid ring pump 10 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 34) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the first operating liquid pipe 40. In some embodiments, operating liquid may additionally be received via the suction line 34 via a spray nozzle. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 34 via the gas inlet 108 and the gas intake of the chamber 102. This gas flows into the volumes formed between adjacent vanes of the impeller 106. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 38.

Returning now to the description of FIG. 1, the exhaust line 38 is coupled between the gas outlet of the liquid ring pump 10 and an inlet of the separator 14. The separator 14 is connected to the liquid ring pump 10 via the exhaust line 38 such that exhaust fluid (i.e. compressed gas, which may include water droplets and/or vapour) is received by the separator 14.

The separator 14 is configured to separate the exhaust fluid received from the liquid ring pump 10 into gas (e.g. air) and the operating liquid. Thus, the separator 14 provides for recycling of the operating liquid.

The gas separated from the received exhaust fluid is expelled from the separator 14, and the vacuum system 2, via a system outlet pipe 42.

In this embodiment, the separator 14 comprises a further inlet 44 via which the separator 14 may receive a supply of additional, or "top-up", operating liquid from an operating liquid source (not shown in the Figures). A second valve 46 is disposed along the further inlet 44. The second valve 46 is configured to control the flow of the additional operating liquid into the separator 14 via the further inlet 44. The second valve 46 may be a solenoid valve.

The separator 14 comprises three operating liquid outlets. A first operating liquid outlet of the separator 14 is coupled to the pump system 16 via a second operating liquid pipe 48 such that operating liquid may flow from the separator 14 to the pump system 16. A second operating liquid outlet of the separator 14 is coupled to an overflow pipe 50, which provides an outlet for excess operating liquid. A third operating liquid outlet of the separator 14 is coupled to a drain or evacuation pipe 52, which provides a line via which the separator can be drained of operating liquid. A third valve 54 is disposed along the evacuation pipe 52. The third valve 54 is configured to be in either an open or closed state thereby to allow or prevent the flow of the operating liquid out of the separator 14 via the evacuation pipe 52, respectively. The third valve 54 may be a solenoid valve.

The separator 14 further comprises a level indicator 56 which is configured to provide an indication of the amount of operating liquid in the separator 14, e.g. to a human user of the vacuum system 2. The level indicator 56 may include, for example, a transparent window through which a user may view a liquid level within a liquid storage tank of the separator 14.

In this embodiment, in addition to being coupled to the separator 14 via the second operating liquid pipe 48, the pump system 16 is coupled to the heat exchanger 18 via a third operating liquid pipe 58. The pump system 16 comprises a pump (e.g. a centrifugal pump) and a motor configured to drive that pump. The pump system 16 is configured to pump operating liquid out of the separator 14 via the second operating liquid pipe 48, and to pump that operating liquid to the heat exchanger 18 via the third operating liquid pipe 58.

The heat exchanger 18 is configured to receive relatively hot operating liquid from the pump system 16, to cool that relatively hot operating liquid to provide relatively cool operating liquid, and to output that relatively cool operating liquid.

In this embodiment, the heat exchanger 18 is configured to cool the relatively hot operating liquid flowing through the heat exchanger 18 by transferring heat from that relatively hot operating liquid to a fluid coolant also flowing through the heat exchanger 18. The operating liquid and the coolant are separated in the heat exchanger 18 by a solid wall via which heat is transferred, thereby to prevent mixing of the operating liquid with the coolant. The heat exchanger 18 receives the coolant from a coolant source (not shown in the Figures) via a coolant inlet 60. The heat exchanger 18 expels coolant (to which heat has been transferred) via a coolant outlet 62.

The heat exchanger 18 comprises an operating liquid outlet from which the cooled operating liquid flows (i.e. is pumped by the pump system 16). The operating liquid outlet is coupled to the first operating liquid pipe 40. Thus, the heat exchanger 18 is connected to the liquid ring pump 10 via the first operating liquid pipe 40 such that, in operation, the cooled operating liquid is pumped by the pump system 16 from the heat exchanger 18 to the liquid ring pump 10.

The second sensor 82 is coupled to the first operating liquid pipe 40 between the heat exchanger 18 and the liquid ring pump 10. The second sensor 82 is a temperature sensor. The second sensor 82 is configured to measure a temperature of the operating liquid flowing (i.e. being pumped by the pump system 16) into the liquid ring pump 10 via the first operating liquid pipe 40. The second sensor 82 may be any appropriate type of temperature sensor. The second sensor 82 is connected to the controller 20 via a second sensor connection 84 such that the measurements taken by the second sensor 82 are sent from the second sensor 82 to the controller 20. The second sensor connection 84 may be any appropriate type of connection including, but not limited to, an electrical wire or an optical fibre, or a wireless connection.

The controller 20 may comprise one or more processors. In this embodiment, the controller 20 comprises two variable frequency drives (VFD), namely a first VFD 201 and a second VFD 202. The first VFD 201 is configured to control the speed of the motor 12. The first VFD 201 may comprise an inverter for controlling the motor 12. The second VFD 202 is configured to control the speed of the motor of the pump system 16. The second VFD 202 may comprise an inverter for controlling the motor of the pump system 16.

The controller 20 is connected to the motor 12 via the first VFD 201 and via a first connection 66 such that a control signal for controlling the motor 12 may be sent from the controller 20 to the motor 12. The first connection 66 may be any appropriate type of connection including, but not limited to, an electrical wire or an optical fibre, or a wireless connection. The motor 12 is configured to operate in accordance with the control signal received by it from the controller 20.

The controller 20 is connected to the pump system 16 via the second VFD 202 and via a second connection 68 such that a control signal for controlling the pump system 16 may be sent from the controller 20 to the motor of the pump system 16. The second connection 68 may be any appropriate type of connection including, but not limited to, an electrical wire or an optical fibre, or a wireless connection. The pump system 16 is configured to operate in accordance with the control signal received by it from the controller 20.

The controller 20 is further connected to the first valve 8 via a third connection 70 such that a control signal for controlling the first valve 8 may be sent from the controller 20 to the first valve 8. The third connection 70 may be any appropriate type of connection including, but not limited to, an electrical wire or an optical fibre, or a wireless connection. The first valve 8 is configured to operate in accordance with the control signal received by it from the controller 20. Control of the first valve 8 by the controller 20 is described in more detail later below with reference to FIG. 3. In this embodiment, control of the first valve 8 by the controller 20 is based on sensor measurements received from the first sensor 81 and the second sensor 82.

The controller 20 may also be connected to the second valve 46 and the third valve 54 via respective connections (not shown in the Figures) such that a control signals for controlling the second and third valves 46, 54 may be sent from the controller 20 to the second and third valves 46, 54.

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

An embodiment of a control process performable by the vacuum system 2 will now be described with reference to FIG. 3. It should be noted that certain of the process steps depicted in the flowchart of FIG. 3 and described below may be omitted or such process steps may be performed in differing order to that presented below and shown in FIG. 3. Furthermore, although all the process steps have, for convenience and ease of understanding, been depicted as discrete temporally-sequential steps, nevertheless some of the process steps may in fact be performed simultaneously or at least overlapping to some extent temporally.

Figure 3:
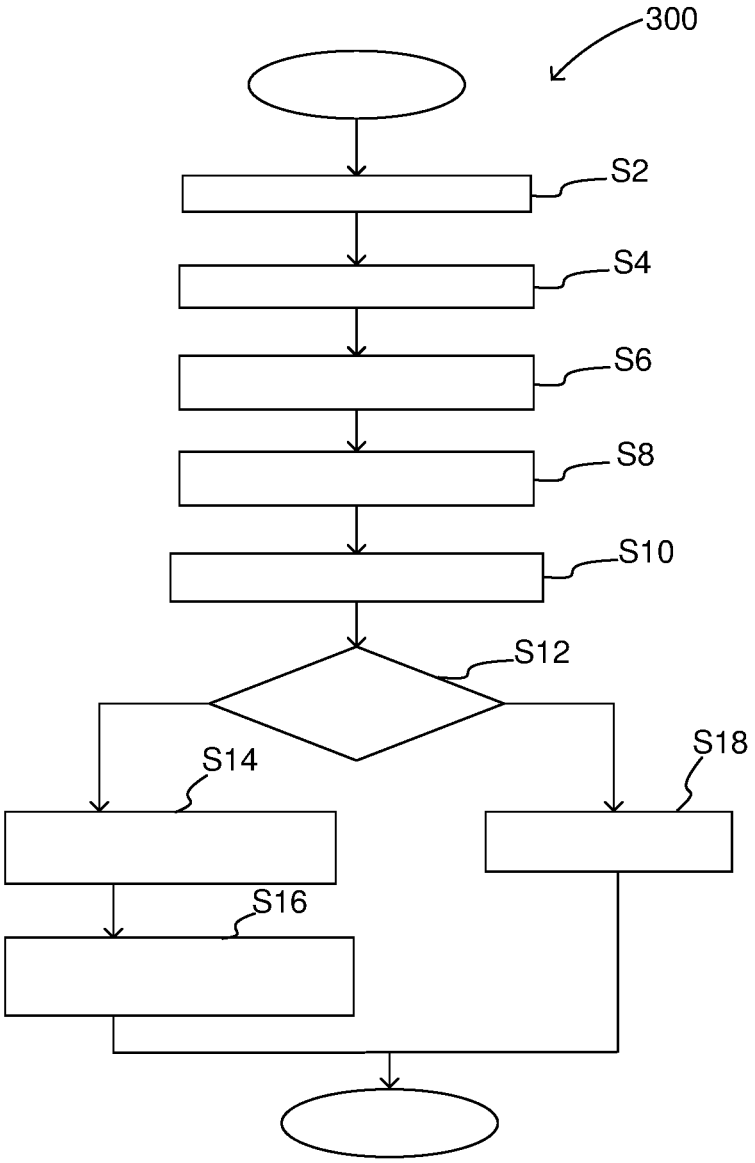
FIG. 3 is a process flow chart showing certain steps of a process performable by the vacuum system.

FIG. 3 is a process flow chart showing certain steps of an embodiment of a control process implemented by the vacuum system 2.

In this embodiment, during the process of FIG. 3, the liquid ring pump 10 is "on", i.e. the liquid ring pump 10 is activated so as to pump gas from the facility 4.

At step s2, the first sensor 81 measures a first pressure $P_1$, the first pressure $P_1$ being the pressure of the gas flowing in the suction line 34, i.e. the pressure $P_1$ of the gas being pumped from the facility 4 by the action of the liquid ring pump 10.

At step s4, the first sensor 81 sends the first pressure measurement $P_1$ to the controller 20 via the first sensor connection 83.

At step s6, the second sensor 82 measures a first temperature $T_1$. The first temperature $T_1$ is a temperature of the operating liquid being received by the liquid ring pump 10 via the first operating liquid pipe 40.

At step s8, the second sensor 82 sends the first temperature measurement $T_1$ to the controller 20 via the second sensor connection 84.

At step s10, the controller 20 calculates, determines, or estimates the vapour pressure (which is also known as the saturation pressure) of the operating liquid in the liquid ring pump 10 using the measured first temperature $T_1$. In this embodiment, the operating liquid is water and, thus, the controller 20 determines the vapour pressure of water for the first temperature $T_1$, which is hereafter referred to as "the water vapour pressure $P_{wv}$". In this embodiment, the water vapour pressure $P_{wv}$ is determined using an approximation formula, in particular the Antoine equation. The water vapour pressure $P_{wv}$ is determined as $$\log_{10}(P_{wv}) = A - \frac{B}{C + T_1}$$

where: A is a constant value known by the controller 20. For example, A may be 7.07406;

B is a constant value known by the controller 20. For example, B may be 1657.46;

C is a constant value known by the controller 20. For example, C may be 227.02; and $T_1$ is the measured first temperature.

In some embodiments, one or more of the parameters A, B, and C may have a different value to that given above.

In some embodiments, optionally the controller 20 may add a so-called offset value to the determined water vapour pressure $P_{wv}$, and this value may be used in the subsequent steps. In other words, the controller 20 may calculate and use the updated pressure value $P=P_{wv}+P_{offset}$, where $P_{offset}$ is the offset value. The offset value $P_{offset}$ may be considered to be a safety margin. The offset value $P_{offset}$ may be any appropriate value including but not limited to a value between 1 mbar and 10 mbar, e.g. 1 mbar, 2 mbar, 3 mbar, 4 mbar, 5 mbar, 6 mbar, 7 mbar, 8 mbar, 9 mbar, or 10 mbar. In some embodiments, use of the offset value $P_{offset}$ is omitted.

At step s12, the controller 20 compares the calculated water vapour pressure $P_{wv}$ to the first pressure measurement $P_1$. For example, the controller 20 may determine a difference $\Delta P$ between the calculated water vapour pressure $P_{wv}$ and the first pressure measurement $P_1$, i.e.

$$\Delta P = P_{wv} - P_1$$

In this embodiment, if the magnitude of $\Delta P$ is less than or equal to a predetermined pressure threshold, $P_{thres}$, (i.e. if $|\Delta P| \leq P_{thres}$) then the method proceeds to step s14. In other words, if the controller 20 determines that the inlet pressure $P_1$ of the liquid ring pump 10 is close (i.e. within a threshold distance, $P_{thres}$) to the water vapour pressure $P_{wv}$, then the method proceeds to step s14.

On the other hand, if the magnitude of $\Delta P$ is more than the predetermined pressure threshold, $P_{thres}$, (i.e. if $|\Delta P| > P_{thres}$) then the method proceeds to step s18. In other words, if the controller 20 determines that the inlet pressure $P_1$ of the liquid ring pump 10 is not close to the water vapour pressure $P_{wv}$, then the method proceeds to step s18. Step s18 will be described in more detail below after the description of steps s14-16.

The predetermined pressure threshold $P_{thres}$, may be any appropriate value, for example 20 mbar. The predetermined pressures threshold, $P_{thres}$, may be adjustable or variable.

At step s14, responsive to the determination that the magnitude of $\Delta P$ is less than or equal to the predetermined pressure threshold $P_{thres}$, the controller 20 controls, via the third connection 70, the first valve 8 to open (or remain open if it is already open).

At step s16, the liquid ring pump 10 draws air into the chamber 102 via its gas inlet 108. Air is drawn into the liquid ring pump 10 through the air pipe 36, via the open first valve 8 and the silencer 9. Air tends to be drawn into the liquid ring pump 10 through the air pipe 36 as a result of the reduced gas pressure within the chamber 102 caused by operation of the liquid ring pump 10. The silencer 9 tends to reduce noise associated with the liquid ring pump 10 drawing in air via the air pipe 36.

The introduction of air into the liquid ring pump 10 at step s16 advantageously tends to cause an increase in the pressure of fluid within the liquid ring pump 10. Thus, the first pressure $P_1$ measured by the first sensor 81 tends to increase. Thus, the error value $\Delta P$ tends to increase.

Increasing the error value $\Delta P$ means that the difference between the first pressure $P_1$ and the water vapour pressure $P_{wv}$ is increased. In other words, the pressure of the gas received by the liquid ring pump is moved away from the water vapour pressure $P_{wv}$. This advantageously tends to reduce the likelihood of the inlet gas causing cavitation in the liquid ring pump 10.

After step s16, the process of FIG. 3 repeats, for example until the vacuum system 2 is shutdown. The process of FIG. 3 may be performed continually, or more preferably continuously during operation of the vacuum system 2.

Returning now to the case where, at step s12, the controller 20 determines that the magnitude of ΔP is more than the predetermined pressure threshold, $P_{thres}$, at step s18, the controller 20 controls, via the third connection 70, the first valve 8 to close (or remain closed if it is already closed).

Thus, air is not drawn into the chamber 102 of the liquid ring pump 10 via the air pipe 36. Thus, the pressure of fluid in the liquid ring pump is not increased by the introduction of air into the chamber 102.

Thus, an embodiment of an anti-cavitation process implemented by the vacuum system 2 is provided.

The above described method may be performed automatically, under control of the controller.

Advantageously, the above described system and second control process tends to allow for the control of fluid temperatures and pressures within a liquid ring pump.

The above described system and second control process advantageously tends to provide for improved reliability of the liquid ring pump.

The above described system and second control process advantageously tends to reduce the likelihood and/or severity of cavitation occurring in the liquid ring pump. For example, cavitation may be caused in the liquid ring pump by the inlet pressure (i.e. the pressure of gas from the suction line) being at or below the vapour pressure of the operating liquid in the liquid ring pump. The above described second control process advantageously tends to adjust the inlet pressure to move it away from vapour pressure of the operating liquid, thereby reducing the likelihood of cavitation. Thus, damage to the liquid ring pump caused by cavitation tends to be reduced or eliminated.

The non-return valve advantageously tends to prevent or oppose undesirable back flow of gas and operating liquid, and tends to be particularly beneficial for the liquid ring pump operated using VFD.

In the above embodiments, the vacuum system comprises the elements described above with reference to FIG. 1. However, in other embodiments the vacuum system comprises other elements instead of or in addition to those described above. Also, in other embodiments, some or all of the elements of the vacuum system may be connected together in a different appropriate way to that described above. For example, in some embodiments, multiple liquid ring pumps may be implemented.

In the above embodiments, the non-return valve 6, the first valve 8, and the liquid ring pump 10 are separate, individual devices. However, in some embodiments, the liquid ring pump may have an integrated non-return valve, e.g. in the inlet manifold of the liquid ring pump. In some embodiments, the liquid ring pump may have an integrated first valve, e.g. in the inlet manifold of the liquid ring pump. In some embodiments, the liquid ring pump may have both an integrated non-return valve and an integrated first valve, e.g. in the inlet manifold of the liquid ring pump.

The inlet manifold of the liquid ring pump having an integral or integrated non-return valve and/or first valve advantageously tends to reduce or eliminate use of a separate section of pipe that contains a non-return valve and/or first valve. This avoidance of a separate non-return valve pipe section and/or first valve pipe section tends to mean that fewer connections (e.g. joints) are formed e.g. between the liquid ring pump and the source of the gas being pumped by the liquid ring pump. This in turn tends to reduce the overall installation size, e.g. height. Also, the risk of leakage tends to be reduced due to the above-mentioned lower number of connections. Thus, efficiency of the liquid ring pump tends to be improved. Also, the material cost associated with the liquid ring pump tends to be reduced, for example because the use of a separate section of pipe containing a valve is reduced or eliminated. Furthermore, the integration of the non-return valve and/or first valve also tends to safeguard against human error during installation of the liquid ring pump at a location.

In addition, a non-return valve and/or first valve integrated in the inlet manifold advantageously tends to restrict flow of gas to a lesser extent than a non-return valve contained in a separate section of pipe.

In the above embodiments, the system comprises a silencer. However, in other embodiments, the silencer is omitted.

In the above embodiments, the air is bled into the liquid ring pump via the air pipe and the first valve. However, in other embodiments, a different gas is introduced into the liquid ring pump. For example, an inert gas, such as nitrogen, may be used. In some embodiments, the fluid (e.g. air) may be introduced into the liquid ring pump at a different location to that described above.

In the above embodiments, the non-return valve does not prevent or oppose air flow to the liquid ring pump via the air pipe. In some embodiments, the non-return valve does not significantly affect airflow to the liquid ring pump via the air pipe, and this air flow is controlled solely via the first valve. However, in other embodiments, the non-return valve may be configured such that, when the non-return valve is in its closed position, the air pipe is open such that air can flow into the liquid ring pump via the air pipe, and such that, when the non-return valve is in its open position, the air pipe is closed by the non-return valve such that air is prevented from flowing into the liquid ring pump via the air pipe.

In the above embodiments, the heat exchanger cools the operating liquid flowing therethrough. However, in other embodiments other cooling means are implemented to cool the operating liquid prior to it being received by the liquid ring pump, instead of or in addition to the heat exchanger.

In the above embodiments, a separator is implemented to recycle the operating liquid back into the liquid ring pump. However, in other embodiments a different type of recycling technique is implemented. The recycling of the operating liquid advantageously tends to reduce operating costs and water usage. Nevertheless, in some embodiments, recycling of the operating liquid is not performed. For example, the vacuum system may include an open loop operating liquid circulation system in which fresh operating liquid is supplied to the liquid ring pump, and expelled operating liquid may be discarded. Thus, the separator may be omitted.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid, e.g. an oil.

The controller may be a proportional-integral (PI) controller, a proportional (P) controller, an integral (I) controller, a derivative (D) controller, a proportional-derivative (PD) controller, a proportional-integral-derivative controller (PID) controller, a fuzzy logic controller, or any other type of controller.

In the above embodiments, a single controller controls operation of multiple system elements (e.g. the motor). However, in other embodiments multiple controllers may be used, each controlling a respective subset of the group of elements.

In the above embodiments, the pump is controlled to regulate or modulate flow of the operating liquid into the liquid ring pump. However, in other embodiments, one or more different type of regulating device is implemented instead of or in addition to the pump, for example one or more valves for controlling a flow of operating fluid. The controller may be configured to control operation of the one or more regulating devices. In some embodiments, the operating liquid flow is not modulated or regulated, and is drawn by the pump's vacuum inlet pressure.

In the above embodiments, the Antoine equation is used to estimate the water vapour pressure $P_{wv}$. However, in other embodiments, the water vapour pressure is calculated, determined, estimated, or ascertained in a different appropriate way, for example using a different approximation such as the August-Roche-Magnus (or Magnus-Tetens or Magnus) equation, the Tetens equation, the Buck equation, or the Goff-Gratch equation.

In the above embodiments, the water vapour pressure $P_{wv}$ is determined based on the first temperature $T_1$, which is measured by the second sensor. The second sensor is coupled to the first operating liquid pipe between the heat exchanger and the liquid ring pump. In other embodiments, the second sensor has a different location. For example, the second sensor may be inside or integral with the liquid ring pump and arranged to measure the temperature of the operating liquid within the liquid ring pump. In some embodiments, the water vapour pressure $P_{wv}$ is determined based on a different temperature, i.e. different to the temperature $T_1$ of the operating liquid being received by the liquid ring pump. For example, in some embodiments, the controller 20 determines or estimates the vapour pressure of the operating liquid in the liquid ring pump 10 using a measured temperature of the exhaust fluid of the liquid ring pump 10 flowing in the exhaust line 38, i.e. the temperature of the air and water mixture being pumped by the liquid ring pump 10 to the separator 14. This temperature of the exhaust fluid of the liquid ring pump 10 flowing in the exhaust line 38 may be measured by a temperature sensor coupled to the exhaust line 38 between the liquid ring pump 10 and the separator 14. This temperature sensor may be any appropriate type of temperature sensor and may be connected to the controller 20 by any appropriate type of connection including, but not limited to, an electrical wire or an optical fibre, or a wireless connection.

In the above embodiments, the error value $\Delta P$ is determined to be $\Delta P = P_{wv} - P_1$. However, in other embodiments the error value is determined in a different way, for example using a different appropriate formula. For example, the error value may be a different function of the first pressure $P_1$ and/or the water vapour pressure $P_{wv}$ and/or the first temperature $T_1$. In some embodiments, weights may be applied to the measured pressure $P_1$ and/or the water vapour pressure $P_{wv}$.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A system comprising:
- a liquid ring pump comprising:
  - a chamber;
  - a suction inlet;
  - an exhaust outlet; and
  - an operating liquid inlet; wherein
  - the liquid ring pump is configured to:
    - pump an inlet fluid into the chamber via the suction inlet;
    - pump an exhaust fluid out of the chamber via the exhaust outlet; and
    - receive an operating liquid into the chamber via the operating liquid inlet;
- a gas line coupled to the liquid ring pump such that a gas may flow into the chamber of the liquid ring pump via the gas line;
- a valve disposed on the gas line;
- a first sensor configured to measure a first parameter of the inlet fluid;
- a second sensor configured to measure a second parameter of a fluid selected from the group of fluids consisting of the operating liquid, the exhaust fluid, and a fluid within the chamber; and
- a controller configured to:
  - determine a vapour pressure of the operating liquid using the measurement of the second parameter; and
  - control operation of the valve based on the measurement of the first parameter and the determined vapour pressure.

2. The system according to claim 1, wherein the first parameter is a pressure.

3. The system according to claim 1, wherein the second parameter is a temperature.

4. The system according to claim 1, wherein the controller is configured to determine the vapour pressure of the operating liquid using the Antoine formula.

5. The system according to claim 1, wherein the controller is configured to compare the measurement of the first parameter and the determined vapour pressure, and to control the operation of the valve based on that comparison.

6. The system according to claim 1, wherein the controller is configured to determine a difference between the measurement of the first parameter and the determined vapour pressure, and to control the operation of the valve based on the determined difference.

7. The system according to claim 6, wherein the controller is configured to compare the determined difference to a threshold value, and to control the operation of the valve based on that comparison.

8. The system according to claim 7, wherein the controller is configured to:
- if the determined difference is greater than the threshold value, control the valve to close or remain closed; and
- if the determined difference is less than or equal to the threshold value, control the valve to open or remain open.

9. The system according to claim 6, wherein the controller is configured to control operation of the valve such that a degree which the valve is opened depends on the determined difference between the measurement of the first parameter and the determined vapour pressure.

10. The system according to claim 1, further comprising:

a suction line coupled to the suction inlet; and a non-return valve disposed on the suction line; wherein the non-return valve is arranged to permit fluid to flow into the chamber via the suction line and to prevent or oppose fluid flow out of the chamber to the suction line; and the gas line is coupled to the suction line between the non-return valve and the suction inlet of the liquid ring pump.

11. The system according to claim 10, wherein the first sensor is coupled to the suction line between the non-return valve and the suction inlet of the liquid ring pump.

12. The system of claim 1, wherein:

the liquid ring pump comprises an inlet manifold; and the valve is integrated in the inlet manifold.

13. The method of claim 1, wherein the gas is air or an inert gas.

14. The system according to claim 1, further comprising:

an exhaust line coupled to the exhaust outlet; and/or an operating liquid line coupled to the exhaust operating liquid inlet; wherein the second sensor is coupled to either the exhaust line or the operating liquid line.

15. A control method for controlling a system, the system comprising a liquid ring pump, a gas line, and a valve disposed on the gas line, wherein the liquid ring pump comprises a chamber, a suction inlet, an exhaust outlet, and an operating liquid inlet, the liquid ring pump is configured to pump an inlet fluid into the chamber via the suction inlet, pump an exhaust fluid out of the chamber via the exhaust outlet, and receive an operating liquid into the chamber via the operating liquid inlet, and the gas line is coupled to the liquid ring pump such that a gas may flow into the chamber of the liquid ring pump via the gas line, the method comprising:

measuring a first parameter of the inlet fluid;

measuring a second parameter of a fluid selected from the group of fluids consisting of the operating liquid, the exhaust fluid, and a fluid within the chamber;

determining a vapour pressure of the operating liquid using the measurement of the second parameter; and controlling operation of the valve based on the measurement of the first parameter and the determined vapour pressure.

* * * * *